United States Patent [19]

Salomon

[11] 4,168,849

[45] Sep. 25, 1979

[54] SKI BRAKE

[75] Inventor: Georges P. J. Salomon, Annecy, France

[73] Assignee: Etablissements Francois Salomon et Fils, Annecy, France

[21] Appl. No.: 878,128

[22] Filed: Feb. 15, 1978

[30] Foreign Application Priority Data

Feb. 16, 1977 [FR] France ..... 77 04396

[51] Int. Cl.[2] ..... A63C 7/10

[52] U.S. Cl. ..... 280/605

[58] Field of Search ..... 280/605, 604

[56] References Cited

U.S. PATENT DOCUMENTS

| | | | |
|---|---|---|---|
| 3,048,418 | 8/1962 | Gertsch | 280/605 |
| 4,012,057 | 3/1977 | Courvoisier | 280/605 |
| 4,061,355 | 12/1977 | Korger | 280/605 |
| 4,066,276 | 1/1978 | Salomon | 280/605 |

FOREIGN PATENT DOCUMENTS

| | | | |
|---|---|---|---|
| 2628005 | 2/1977 | Fed. Rep. of Germany | 280/605 |

*Primary Examiner*—Joseph F. Peters, Jr.
*Assistant Examiner*—Gene A. Church
*Attorney, Agent, or Firm*—Pollock, Vande Sande & Priddy

[57] ABSTRACT

The invention concerns braking devices for skis that will ensure their immobilization when unexpectedly separated from the ski boot.

For a ski which is put on by positioning the boot at an angle and then pivoting it to lock it in place, the ski brake includes a braking element 17 mounted on a pin 17 whose extremity 21 is pushed back by the boot during pivoting so that the braking element is raised counter to the action of a spring.

This arrangement facilitates placing the boot on the ski at an angle.

33 Claims, 23 Drawing Figures

1
2
3
4
5
6
7
11
14
23
26
27
28
30
30'
31
31'
32
33
34
35
36
36'
F3
F4
F4'

2
3
4
5
6
11
27
28
29
30
31
32
34
36
37

603
600
605
601
606
573
570
602
590
604
574

61
60
9
6
57
59
7
5
55
FR 590
570
572
592
560
571
591
550

2
58
56
6"
9
60
11
7
8
57
b
10
6
6"
5
61
a
12
62
c
55
59

106
FI
102
103
104
100
101
105

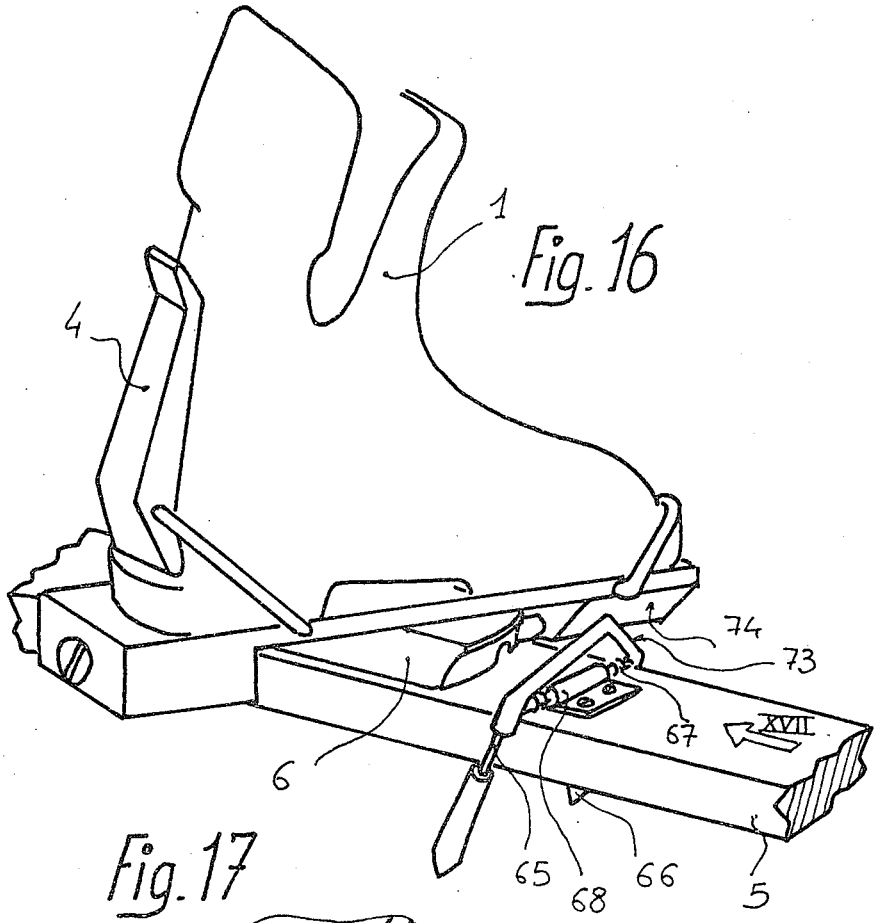
Fig. 16
Fig. 17
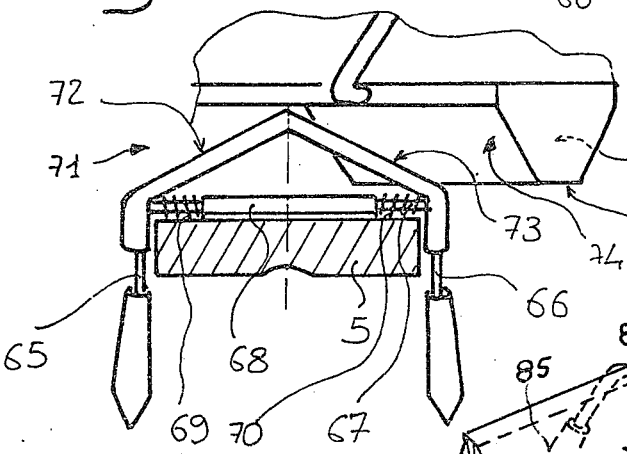
Fig. 18
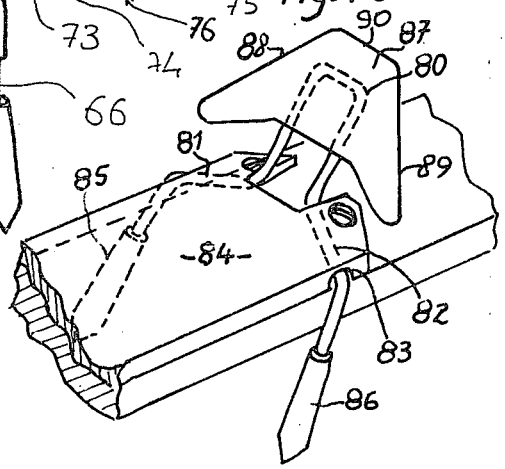

SKI BRAKE

The present invention concerns a ski-brake device for ensuring the braking and immobilization of the ski when it is unexpectedly separated from the ski boot during skiing.

The invention more specifically concerns a braking device for a ski provided with bindings for keeping the boot on the ski, whereby the ski is put on by placing the boot at an oblique angle thereto and parallel to its upper plane surface, then by appreciably turning the boot within the plane of the ski so that it becomes aligned with the longitudinal axis thereof, in which position the binding ensures the interlocking of the boot and the ski.

This type of binding is well-known and is used primarily when the boot is attached temporarily for skiing to a plate; the aforementioned binding maintains the boot and the plate on the ski under a trigger-release.

Some of these known systems are provided with a ski brake with braking arms that are retracted over the sliding surface of the skies when the skis have been put on. When a safety release is actuated, the ski is separated from the boot or the plate-boot unit and the ski brake is released and automatically assumes the braking position, i.e., its arms extend from under the lower plane of the ski and dig into the snow. These known types of ski-brake bindings are difficult to put on, especially when the skier is on a slope, and they may also be problematical if a system is involved in which the boot revolves around a center-pin. In these center-pin type bindings, the braking arms change from their braking position extending from beneath the ski to their inactive position over the sliding surface of the ski during the initial phase of putting on the ski, i.e., when the skier places his boot at an angle to the ski, then uses a vertical motion to apply the boot against the ski while centering said plate on the ski, and particularly on the center-pin thereon.

It can be seen immediately that while the skier, during this operation, is attempting to engage the boot on the pin (which is not easy in that the pin is out of view under the sole of the skier's foot), he must overcome the power of the brake by moving his foot vertically in the direction of the ski. This operation requires great dexterity from the skier in centering the boot on the pin, and considerable vertical pressure to overcome the resistance of this ski brake, which is inconvenient enough when the ski is on a flat surface, but is virtually impossible when the skier is on a slope.

Furthermore, if the skier manages to center the plate on the pin while he changes the brake from the active to the inactive braking position, but releases his vertical thrust before he can turn his foot around to the direction of the ski, which he must do to bring the boot into the locking position, the energy accumulated in the brake while under pressure is released and the plate springs back out of contact with the ski. Under these conditions, it can be seen that all of the operations involved in putting on the ski have to be started over again.

The present invention proposes to overcome the aforementioned drawbacks, and to this end, the invention concerns a braking device adapted to a ski provided with a binding which is put on by rotating the foot in a plane parallel to the ski and wherein the action of raising the braking device occurs during the boot-rotating phase, preferably at the end of said phase. It can be seen that in this way, the placement of the boot on the ski becomes extremely easy and that the disadvantages caused by the presence of the ski brake are greatly reduced, particularly when there is a center-pin on the ski or the boot.

More specifically, the braking device of the invention includes, in a standard way:

at least one braking element which can move in relation to the ski between an inactive position in which the element is raised over the bottom of the ski, and an active braking position in which the brake protrudes from the underside of the ski;

and means of control for triggering the braking element and which react in the presence or absence of the boot on the ski.

The braking device of the invention is characterized by the fact that the control means are designed in such a way that when the boot is placed on the ski, the rotating movement of the boot in the plane of the ski is transformed into a movement of displacement of the braking element from its active position to its inactive position.

More specifically, said control means have, with respect to the ski, at least one moving part which cooperates with the braking element and which is pulled elastically into a protruded position in relation to at least one part of the zone covered by at least one element connected to the boot during the rotation of the latter within the plane of the ski said element ensuring the displacement of the moving part and, consequently, that of the braking element as well.

It will be observed that the moving part is by preference attracted elastically into its protruding position by an elastic element which simultaneously recalls the braking device to its active position.

Based on this general definition, various embodiments of the invention can be developed. For example, the moving part could be displaceable from its protruded position to a retracted position, wherein it is maintained by the element attached to the boot, either by rotation around a fixed axis in relationship to the ski (whether this axis is parallel or perpendicular to the plane of the ski), or by translation, specifically in the plane of the ski and more specifically in a direction parallel to the longitudinal axis thereof.

Several embodiments of the invention will now be described as non-limiting examples, with reference to the attached drawings, in which.

Figure 5:
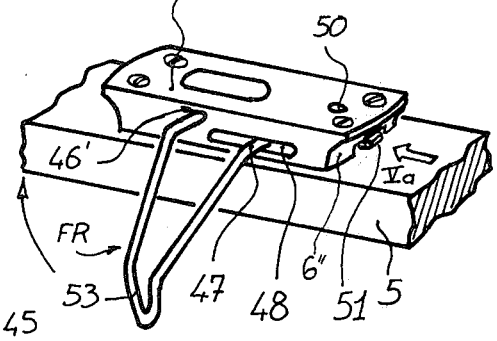
FIG. 5 is a view in perspective showing a third embodiment of the device according to the invention.
Figure 5A:
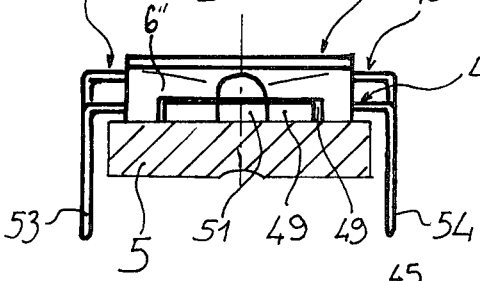
Figure 6:
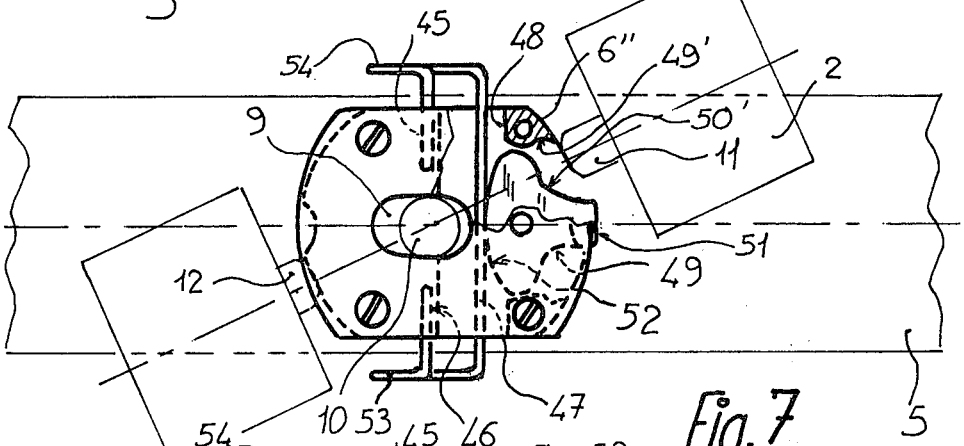
Figure 7:
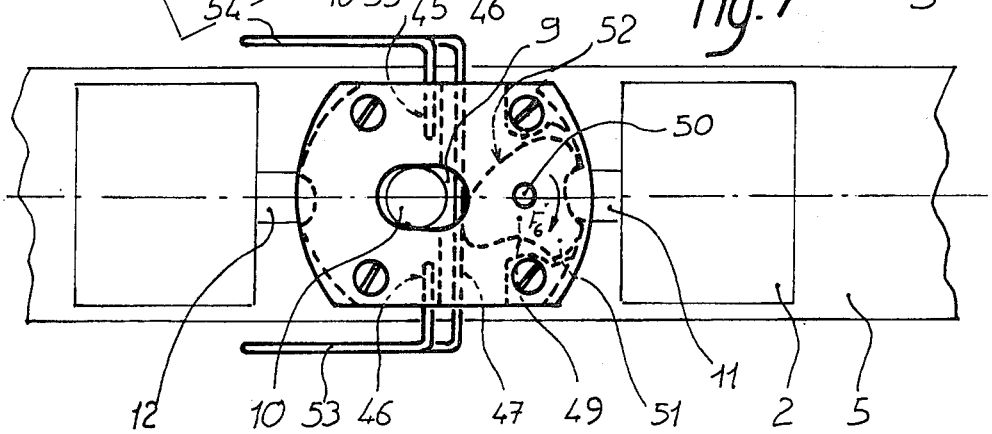
Figure 8:
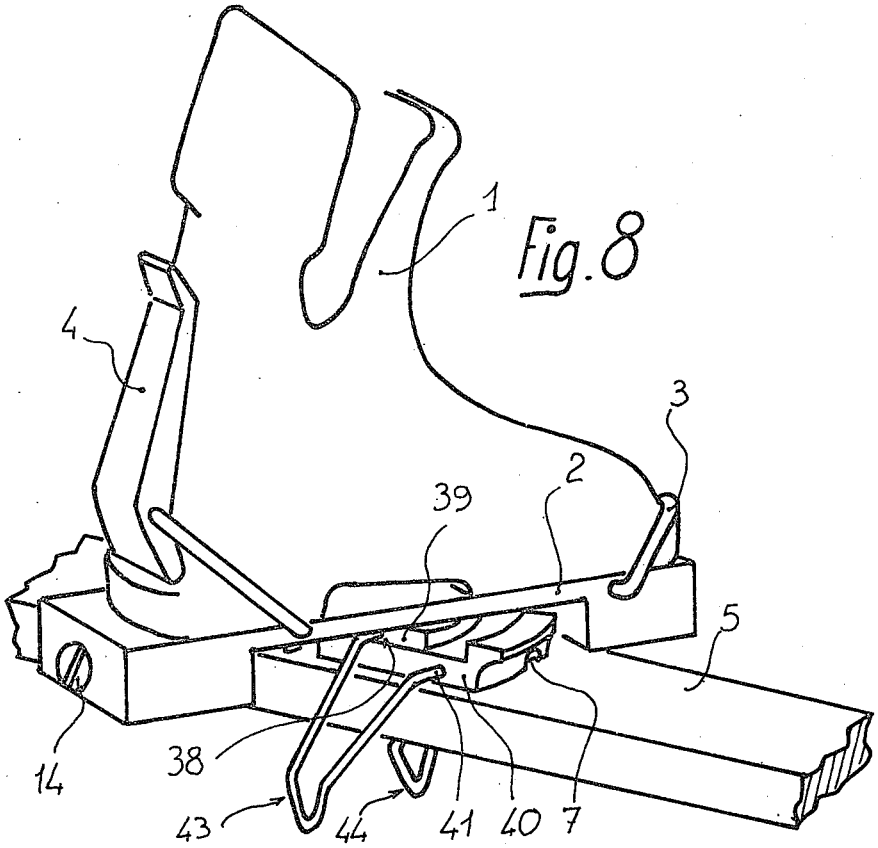
Figure 9:
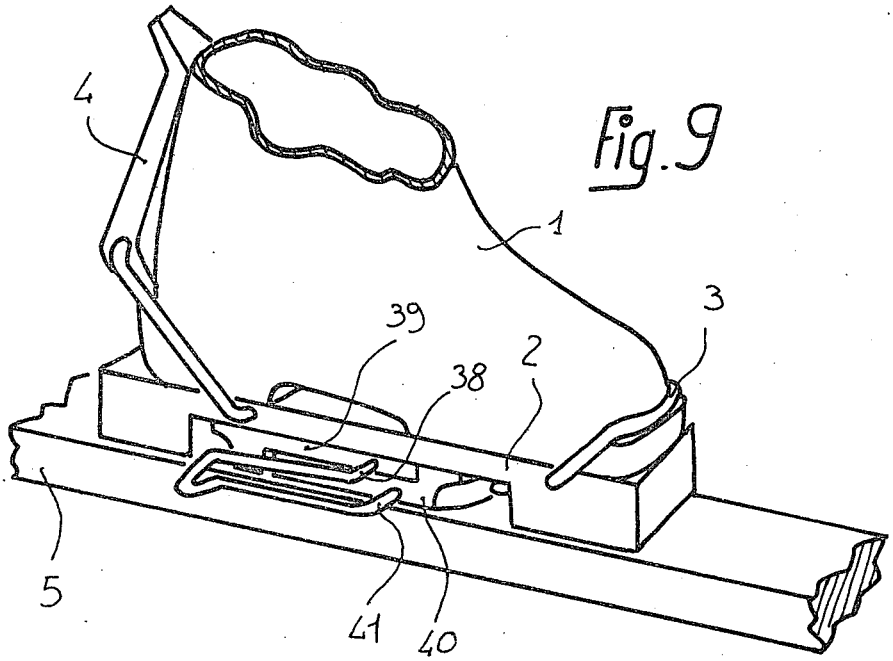
Figure 10A:
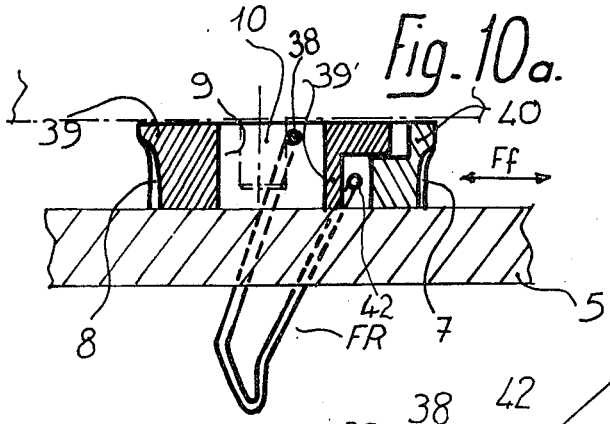
Figure 10:
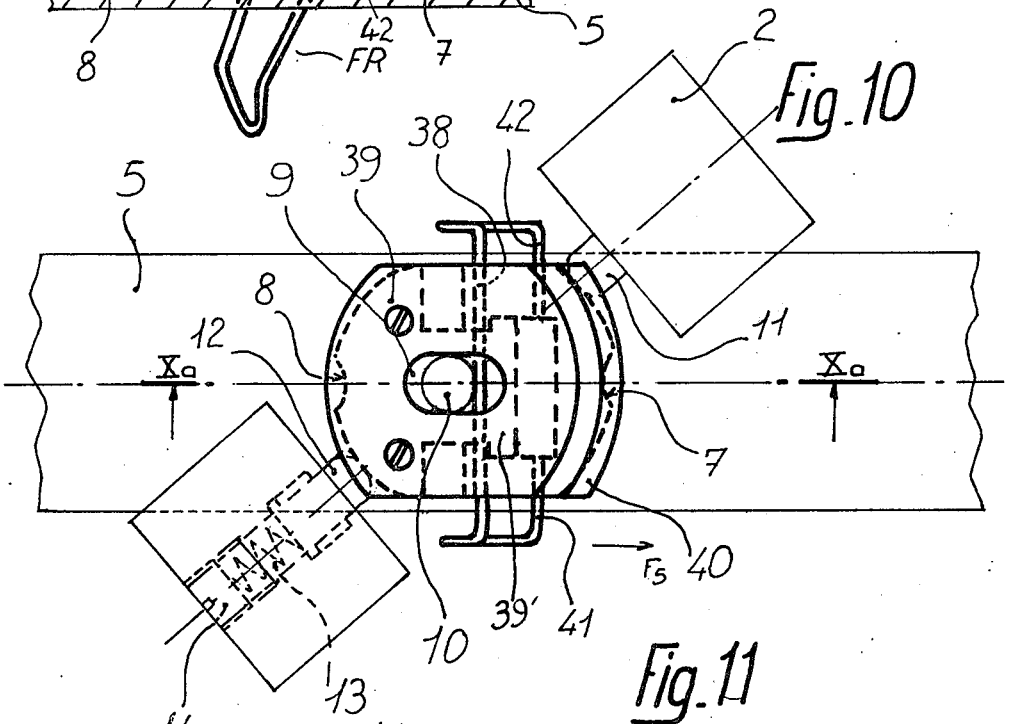
Figure 11:
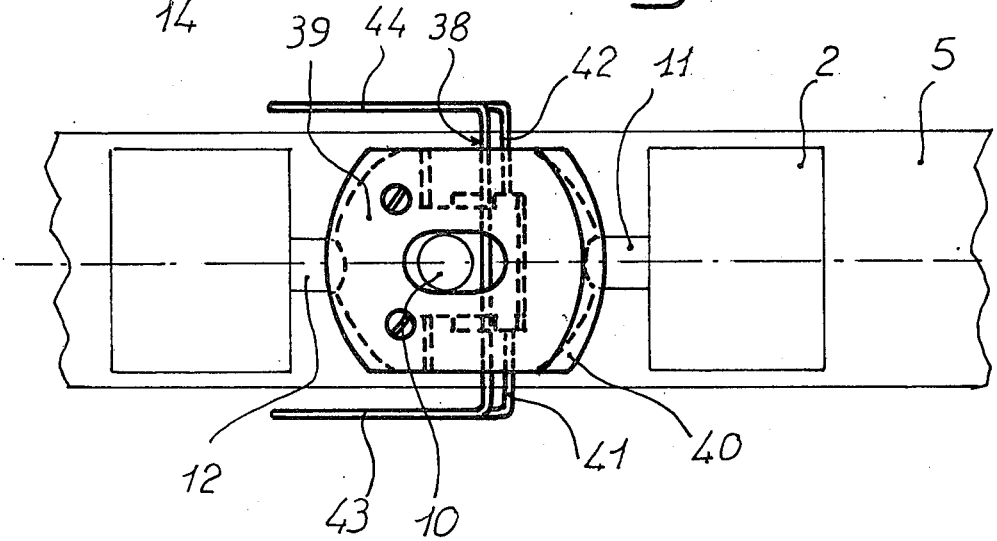
Figures 12, 12A, 12B, 12C, 13:
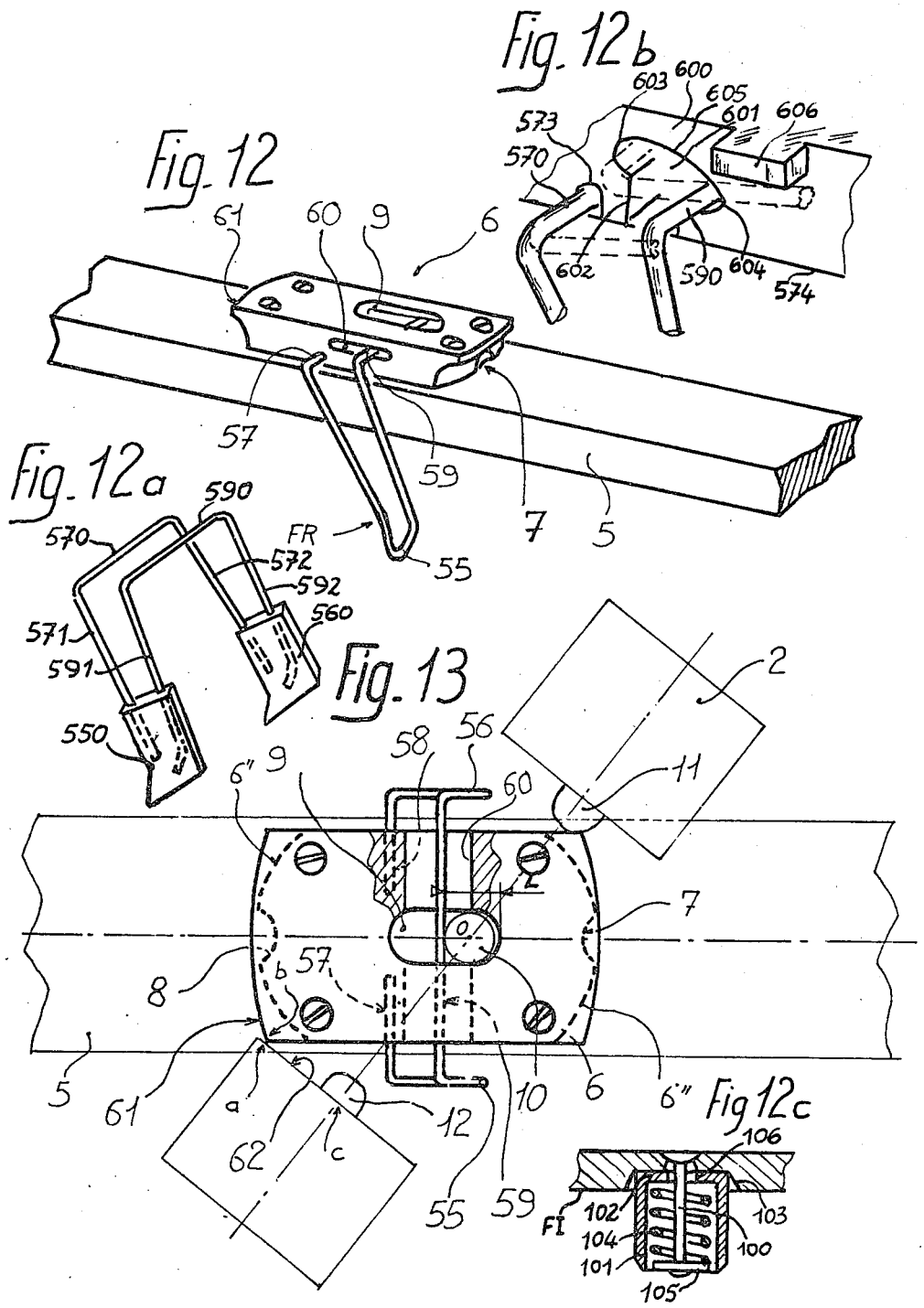
Figure 14:
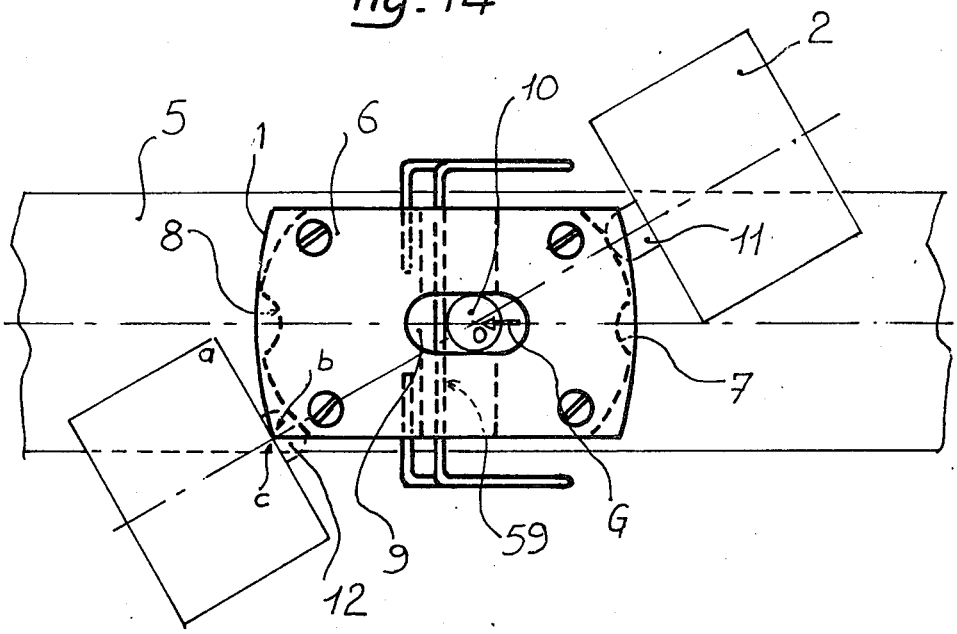
Figure 15:
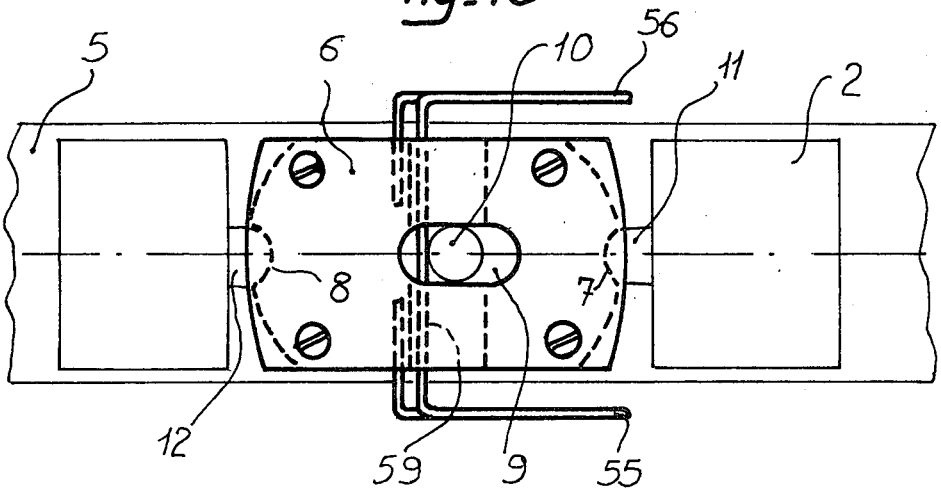

FIG. 5*a* is a view on a larger scale along arrow Va of FIG. 5;

FIGS. 6 and 7 are top views of the device in FIGS. 5 and 5*a* in the braking position and inactive position, respectively;

FIGS. 8 and 9 are views in perspective of a fourth embodiment of the device according to the invention, showing the braking device in the active and inactive positions, respectively;

FIGS. 10 and 11 are schematic top views of the device of the invention corresponding to the positions in FIGS. 8 and 9, respectively;

FIG. 10*a* is a cross-section along line Xa—Xa of FIG. 10;

FIG. 12 is a schematic view in perspective of a fifth embodiment of the device according to the invention;

FIGS. 12*a*, 12*b* and 12*c* show possible modifications in some of the components of FIGS. 12 and 13;

FIG. 13 is a top view of the device shown in FIG. 12, illustrating the active braking position;

FIGS. 14 and 15 are similar views to the view in FIG. 13 and show two other positions of the device according to the invention;

FIG. 16 is a schematic view in perspective of another embodiment, and

FIG. 17 is a schematic view along arrow XVII of FIG. 16, and

FIG. 18 is a variant of a brake similar to that shown in FIGS. 16 and 17.

In the description which follows, reference is made to plate-type bindings in which the boot is placed on the ski by rotating the foot around a pin in a plane almost parallel to that of the ski. These known plate-type bindings, however, are given solely as examples; it would of course be possible to use different systems, particularly one in which there is no plate between the boot and the ski and no actual pin. The main point is that putting on the ski is always a two-phase operation, the first making it possible to place the boot almost parallel but obliquely to the ski, and the second consisting of a rotation of the skier's foot and the elements attached thereto in order to bring them into alignment with the longitudinal axis of the ski. It should be noted that the plate-type bindings described in the examples below are of the general type discussed in the French patent application filed on Sept. 3, 1976 in the name of the applicant for a "Releasable safety binding for skis".

Figure 1:
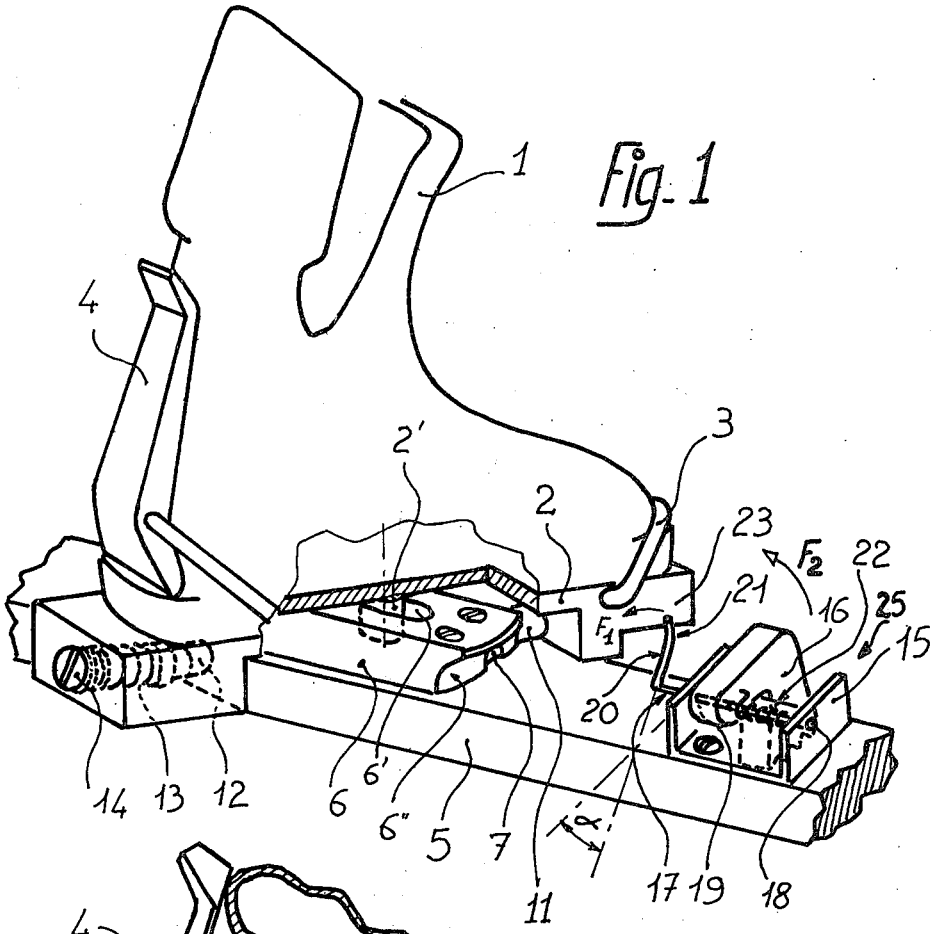
FIG. 1 is a view in perspective of an initial embodiment of the device according to the invention, showing the braking element in its active braking position.

This known device will not, therefore, be described in detail; it will be sufficient to recall, as seen particularly in FIG. 1, that for skiing, boot 1 is removably maintained on an intermediate plate 2 by means of front and rear locking elements 3, 4 which are of the standard type. The safety releases during skiing occur between plate 2 and ski 5 by means of a fastening system which in the examples shown is of the type described in the aforementioned patent application. In this instance, the fastening system consists of:

a pivot-block 6 which may be screwed onto the ski along its longitudinal axis; the upper part of this pivot-block has a longitudinal, oblong opening 6′ which, when the ski is put on, admits a nib 2′ protruding from under plate 2; block 6 also has guiding surfaces 6″ in front and in back which, as required, can be shaped like a section of a propeller and which extend as far as a housing 7 located on the longitudinal axis of the ski;

and complementary elements in plate 2 and including a front, horizontal finger which engages in forward housing 7 of the pivot-block (finger 11 is by preference stationary), as well as a rear finger 12 which can move axially inside a housing located in the rear part of plate 2; finger 12 is pulled forward by a flexible device such as a spring 13 connected to a screw 14 for adjusting the compression of the spring which thereby makes it possible to change the triggering force; when the boot is on the ski, movable finger 12 cooperates with a housing (not shown, but similar to housing 7) placed behind pivot-block 6.

To put on the binding, the boot is placed across the ski as seen in FIG. 1 by introducing nib 2′ into the corresponding oblong hole 6′ in the plate. In this position, as can be seen clearly in the drawings, the boot and its plate are away from the ski brake, and this oblique positioning can be obtained with no special difficulty. The foot is then turned in the plane of the ski so that fingers 11 and 12 come into contact with guiding surfaces 6″ of the pivot block; locking occurs when said fingers 11 and 12 engage in the housings (one of which is shown at 7) of pivot block 2 (see the position illustrated in FIG. 2).

Figure 2:
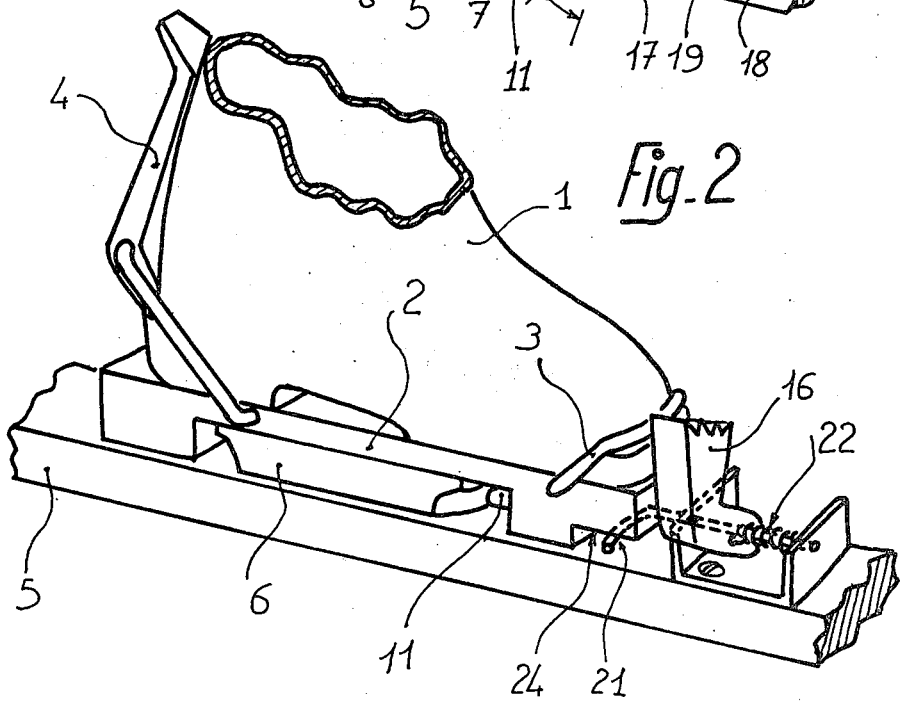
FIG. 2 is a view in perspective which is similar to that of FIG. 1, but in which the braking element is in its retracted position after the boot has been locked into its fastened position on the ski.

In the embodiment represented in FIGS. 1 and 2, the ski brake, which is given the general indication 25, includes U-shaped support plate 15 attached to the ski by screws. Braking element 16, which in the example shown is elbow-shaped, is supported by the rectilinear part of a rod 17 which crosses one of the ends of said element 16 and pivots in holes 18 and 19 pierced in the vertical sides of support plate 15. It can be seen that the pivoting part of rod 17 extends almost parallel to the longitudinal axis of the ski and that part 16 is rotationally integral with rod 17.

In the direction of block 6, rod 17 protrudes from support 15 and is extended by a part 20 which is relatively perpendicular to rod 17 and appreciably curve-shaped in its end part 21. In addition, a spring 22 surrounds rod 17 and is anchored by one of its extremities onto plate 15 and by its other extremity onto braking element 16, in such a way that said spring normally acts upon braking element 16 in the position shown in FIG. 1, which is the braking position.

In this active braking position, the extension 20 of rod 17 forms an angle with the surface of the ski (see FIG. 1) such that this part 20 is maintained in an extended position in the space that the boot-plate unit will sweep during its rotating movement. At the time of the rotating movement, the front side part 23 of plate 2 will cooperate with the end part 21 of the rod and drive it into rotation around rod 17 in the direction of arrow $F_1$, which ensures the raising of braking element 16 along arrow $F_2$ against the action of a spring 22. In the assembled position shown in FIG. 2, braking element 16 is therefore in the raised position and extremity 21 is held against the lower surface 24 of the front part of the plate.

As illustrated in FIGS. 1 and 2, the forward part of the plate will preferably be recessed, so that the lower surface 24 against which extremity 21 comes to rest can accommodate the passage of this element 21. Lateral part 23 is vertical here, but could advantageously be inclined downward, thereby constituting a mounting ramp (as represented, for example, in FIGS. 16 and 17). Its shape could also be round.

Figure 3:
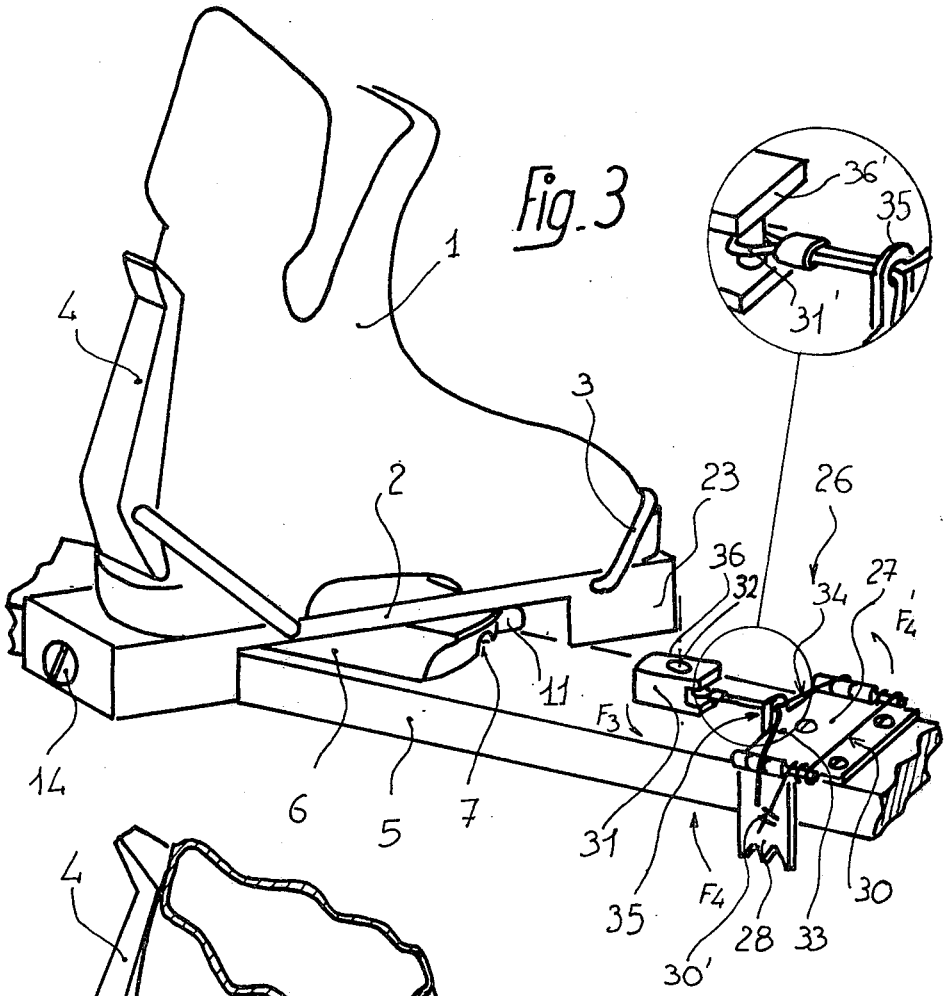
FIGS. 3 and 4 are views in perspective of a second embodiment of the device according to the invention, illustrated in the active and inactive braking positions, respectively.
Figure 4:
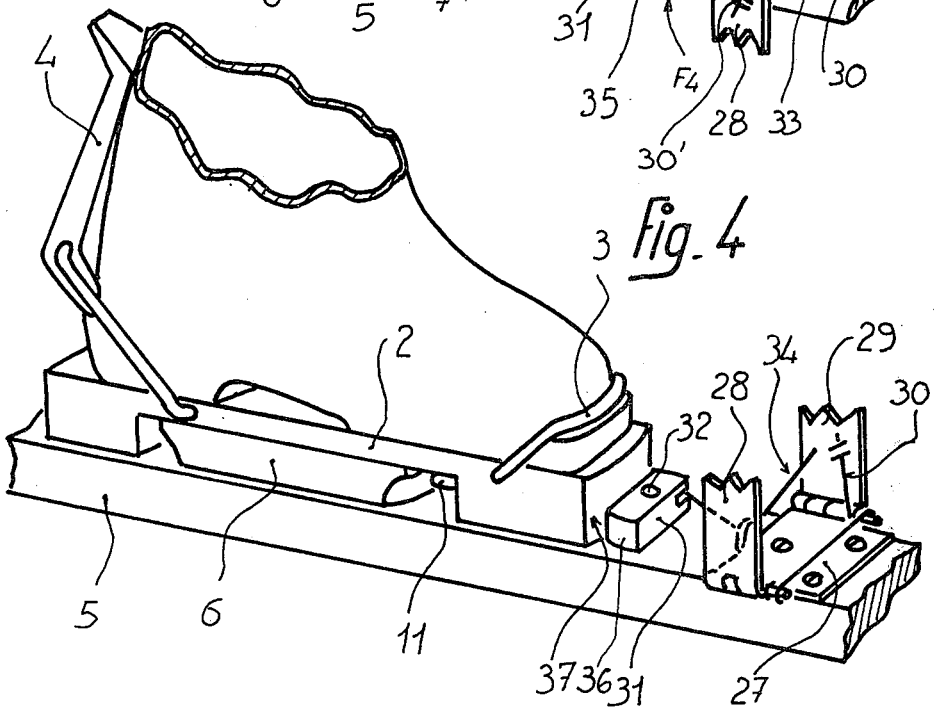

FIGS. 3 and 4 show a second embodiment of the invention. The ski brake, here designated in general by reference number 26, includes a support-plate 27 which may be attached to the ski by means of screws. Linked on the lateral edges of this plate 27 (e.g., by a standard system of hinges) are two braking elements 28 and 29 constituted by plates and whose free extremity is toothed. Braking elements 28 and 29 are normally pulled downward by a spring 30, constituted in the example shown by a single steel spring wire tightened between the hinges of plates 28 and 29, around which it is coiled, while the free ends of spring 30 are affixed at 30′ against braking elements 28 and 29. In the longitudinal axis of the ski, plate 27 has an eyelet 35 through which cables 33 and 34 pass, their free ends attached to one of the braking elements 28 or 29, respectively and the other end attached at 31' to the extremity 36 of a lever 31 which is pivot-mounted around a vertical center-pin 32 situated on the longitudinal axis of the ski. Pin 32 is naturally stationary vis-a-vis the ski. Beyond pin 32 in the direction of pivot-block 6, one free end 36 of the lever is preferably rounded.

In placing the boot on the ski, when the boot is rotated, side part 23 of the front of the plate comes to rest against the extremity 36 of the lever, which it forces to turn along arrow $F_3$. With this movement, cables 33 and 34 are drawn backward, sliding into eyelet 35 and causing braking elements 28 and 29 to rise by traction. This produces the booted position shown in FIG. 4.

In order to ensure the proper positioning of the elements, the front part 37 of the plate is shaped like the arc of a circle and is centered on the plate-supported nib 2'.

In the embodiment illustrated in FIGS. 5 to 7, the braking element is constituted by a steel spring-wire, given the general indication FR and mounted in pivot-block 6. The extremities 45 and 46 of this spring-wire FR are aligned noticeably perpendicular to the longitudinal axis of the ski and constitute an initial disconnected fragment of the braking element pivot-mounted in housings 46' arranged in the sides of block 6. The fragment constituting extremities 45 and 46 is extended laterally by bent prolongations 53–54 perpendicular to disconnected fragment 45–46, forming arms for digging into the snow; these bent prolongations 53–54 are connected by a joint middle fragment 47, relatively parallel to disconnected fragment 45–46; this part 47 is housed slidingly in an oblong opening 48 made transversely in pivot-block 6.

The structure of bent spring-wire FR is such that in the normal position shown in FIGS. 5 and 5*a*, parts 53–54 protrude from the underside of the ski.

In a housing 49' arranged axially in pivot-block 6 and opening on the one hand inside of inlet 48 and on the other hand on the front part of pivot-block 6, a feeler-lever 49 is pivot-mounted around a pin 50. This feeler-lever has a feeling lip 51 which extends in the direction of the opening toward the exterior of housing 49'. Opposite the feeling lip in relation to pin 50, the feeler-lever also has a cam-shaped section which is in contact with the sliding part 47 of ski-brake FR. It will be observed that the cam-shaped part 52 of the feeler is connected to the feeling lip 51 by lateral concave parts 50'.

In addition, in the normal braking position illustrated in FIG. 6, lip 51 protrudes outward from pivot-block 6, past guiding surfaces 6''.

When the ski is to be put on, and when the plate is rotated, the front finger 11 of the plate will push back feeling lip 51, thereby forcing feeler-lever 49 to turn in the direction of arrow $F_6$ of FIG. 7. Cam-shaped part 52 will then push back part 47 of the ski-brake by causing it to slide into inlet 48 in the direction of arrow $F_6$ in FIG. 7, which will generate an upward displacement of ski-brake arms 53 and 54 where they will be positioned over the sliding plane of the ski, as shown in FIG. 7. It should be noted that the braking elements will be maintained in this raised position through immobilization of the feeler lever when finger 11 enters the convex part 50' of feeler lever 49.

When the plate and the ski become separated, particularly after a safety release, finger 11 will free lever 49, which will automatically resume its initial position, thanks to the pressure of ski-brake part 47 on cam 52, and the braking elements will by themselves resume their active position represented in FIG. 5.

As evident in FIG. 5 especially, the central part or fragment 47 and the disconnected fragment 45 and 46 of the ski brake will preferably be situated in planes which are parallel to the ski and be apart from each other in order to facilitate the raising of arms 53–54.

In the embodiment illustrated in FIGS. 8 to 11, a ski-brake arrangement is found which is similar to that of FIGS. 5 to 7. The essential difference, however, is in the fact that instead of being constituted by a single part, the pivot-block is constituted by two elements which are movable in relation to each other. One of these elements, 39, is screwed onto the ski and has a lower, guide-block shaped part 39'; the oblong inlet 9 which accommodates nib 10 of the plate is cut out from the thickness of part 39. The other element constituting the pivot-block is given the reference 40 and resembles a U-shaped part recumbent on the ski, slide-mounted on part 39' of element 39. Element 39 has a housing 8 in which the rear mobile finger 12 of the plate will engage, and element 40 has a housing 7 for the stationary finger 11 in the front part of plate 2. Element 40 is designed so that it moves in translation along the double arrow Ff of FIG. 10*a*. As in the previous embodiment, ski-brake FR is constituted by a bent, steel rod, the central part of which, or central fragment 38, parallel to the plane of the ski and transverse to the longitudinal axis thereof, is swivel-mounted in a suitable housing in element 39 of the pivot-block; this central part 38 is positioned so that it crosses inlet 9, as shown in FIG. 10. Said central part 38 is extended by curved parts whose free ends 41 and 42 constitute a disconnected fragment and are parallel to part 38 and are swivel-mounted in the housings provided in element 40 of the pivot-block (see FIGS. 10 and 10*a*).

When the boot is being placed on the ski, and especially when the boot is rotated, stationary finger 11 of the sole will cause element 40 to move in the direction of element 39, assuming the position shown in FIG. 11. Consequently, the displacement of fragment 41 and 42 in relation to intermediate fragment 38 will result in the repositioning of braking elements 43 and 44 above the plane of the ski.

It can be seen in FIG. 10*a* that element 40 of the pivot-block is always attracted forward along arrow $F_5$ of FIG. 10, because of the elasticity of the brake, which will always tend to reassume its position of rest, protruding from the underside of the ski. This is made possible by the configuration given the ski brake by the manufacturer.

Furthermore, as noted in the previous form of embodiment, the central part 38 of the ski brake will be in a different plane (upper, in this example) from the plane of the disconnected fragment 41 and 42 in order to facilitate the raising of the brake.

Another embodiment of the invention which is a variant of the two previous embodiments described will now be explained with reference to FIGS. 12 to 15.

In this example, ski brake FR which is also constituted by a flexible spring wire, is mounted in pivot-block 6 in such a way that middle part 59 or the middle fragment of the ski brake extends freely within an oblong passage 60 extending through block 6 parallel to the plane of the ski. The extremities 57–58 of the ski brake, constituting a disconnected fragment, are swivel-inserted in appropriate housings provided in block 6 and removed from passage 60. The vertical inlet 9 made in pivot-block 6 for nib 10 under the surface of plate 2 crosses slot 60, as seen in FIG. 13. The structure of the ski brake is such that in the normal position, braking elements 55 and 56 are lowered in the position of FIG. 12, with the intermediate part 59 of the ski brake a distance of L away from the front wall of inlet 9, allowing for the passage of nib 10.

At the start of the operation, i.e., when the boot is positioned at an oblique angle to the ski, the skier can easily engage nib 10 in inlet 9 without being hindered by the ski brake. When the skier turns his foot in line with the ski, fingers 11 and 12 of the plate cooperate with guiding surfaces 6″ provided in front and in back of the pivot-block (see FIG. 13), and nib 10 is displaced inside inlet 9 in the direction of arrow G; this movement of translation pushes back intermediate part 59 of the ski brake in the direction of fragments 57–58.

The longitudinal displacement of nib 10 in inlet 9 is due to the fact that at the start of the operation, point "b" of the upper edge 61 of pivot-block 6 cooperates at "a" with part 62 of the plate; during the rotation of the plate, point "b" of block 6 will come in contact with point "c" (FIG. 14) of the plate. Since distance Oa is greater than Oc (0 being the center of the nib), nib 10 will be displaced in the inlet. Thereupon, the cooperation of finger 12 with ramp 6″ which is compressive (i.e., its shape ensures the gradual compression of at least one of fingers 11–12), ensures the ongoing displacement of the nib in its inlet. This movement causes the raising of braking elements 55 and 56, and the assembly is locked in the position shown in FIG. 15 when fingers 11 and 12 engage in the housings 7 and 8 provided in front and in back of the pivot-block 6. When the plate is released, e.g., after the safety mechanism has been triggered, nib 10 escapes from its inlet 9 and the brake returns by itself to the initial position of FIG. 12 as a result of the restoration of the energy stored when the boot was positioned on the ski.

In the preceding example, fingers 11 and 12 are both advantageously elastically mobile.

As a variant, one of the fingers (e.g., finger 12) could be stationary and integral with the boot, while only finger 11 would be elastically mobile (connected to a spring). In this case, the displacement of nib 10 would be obtained through the cooperation of stationary finger 12 with ramp 6″.

Naturally, various arrangements or modifications could be possible for the embodiments shown in FIGS. 12*a*, 12*b* and 12*c*.

For example, a braking element such as the one in FIG. 12*a* could be used, where instead of a single curved metal rod as in FIG. 12, there would be two almost U-shaped metal wires with a fragment 570 (which would swivel as fragments 57 and 58 of FIG. 12 in the bearing of pivot-block 6) and a fragment 590 (which would have the same function as the middle part 59 of FIG. 12, sliding into a groove in the pivot-block), respectively; fragments 570 and 590 would be almost parallel and are extended by portions bent at an angle of 90° (571–572 and 591–592, the ends of which are connected in pairs by an end-block 550 and 560, cast from existing plate. It is, of course, understood that the braking element of FIG. 12*a* is the structural and operational equivalent of the braking element of FIG. 12.

Moreover, to facilitate assembly and disassembly of the braking element, the bearings and grooves of the pivot-block could be arranged as in FIG. 12*b*. It can be seen that the circular bearing 573 in which pivoting fragments 570 or 57–58 are engaged emerges under the lower surface 574 of pivot-block 600. Furthermore, groove 601 in the pivot-block emerges on the lower surface of the latter through a slot 602 for positioning the fragments (590–59); the extremities 603–604 of the groove protrude from the front and the rear of slot 602. In addition, the upper wall 605 of groove 601 is advantageously curved, functions as a ramp, the concave side of which is turned toward slot 602. Lastly, ramp 605 is inclined vis-a-vis the plane of the ski, rising from extremity 604 to extremity 603.

As is also evident from FIG. 12*b*, a thrust-block 606 can be advantageously provided on at least one side of pivot-block 600, making it possible to limit the upward displacement of the braking elements (as represented by the broken lines). In fact, if the braking elements rose too high, they could hinder the oblique displacement of the boot both when the ski is being put on and when being removed (whether voluntarily or by the safety release). Thrust-block 606, therefore, will function as a safety element, ensuring that the braking elements will never create such a hindrance.

Due to the presence of thrust-block 606, it would be particularly advantageous, especially if front finger 12 were stationary with respect to the boot, to provide an elastic element between nib 10 and the sliding fragment of the braking element. The desired flexibility could be obtained in various ways, e.g., by using a fragment 59 or 590; the part cooperating with the nib would be more flexible that the remainder of the fragment. An elastic fragment could also be used, or an intermediate part between the nib and fragment 59–590, which would be elastic.

In the preferred case, using an elastic nib, the construction could be of the type shown in FIG. 12*c*. In this figure, a rod 100 is mounted perpendicular to the lower surface FI of the sole of the boot or of the plate under the boot. Mounted on this rigid rod 100 is a hollow sleeve 101 whose bottom 102 is inserted in a depression 103 of the lower surface FI by means of a spring 104 surrounding rod 100 and operating between a fixed end washer 105 of the rod and the bottom 102 of the sleeve. The opening 106 in the bottom of the sleeve is wider than the diameter of rod 100, thereby allowing the sleeve to tilt back and forth on either side of rod 100.

FIGS. 16 and 17 illustrate a final embodiment of the invention. In this example, the ski brake used is constituted by two braking elements 65 and 66, connected to bearing 68 by means of a spindle 67 with which they are integral, said braking element being subjected to the action of, for example, two springs 69 and 70 which will keep them extended under the plane of the ski. The braking elements are also integral with a control lever 71 which, in the example shown, is in the shape of an upside down "V", and thereby has two inclined ramps 72 and 73 for putting on the ski, by rotating the boot either to the left or to the right. The plane formed by the control element and spindle 67 is transverse to the longitudinal axis of the ski. The front side part of the plate is also ramp-shaped, sides 74 and 75 converging toward the ski. Thus, when the foot is turned, a pair of ramps 73–74 or 72–75 will cooperate to ensure that the brake is raised by tilting the assembly around spindle 67. A central horizontal zone 76 is advantageous provided between ramps 74–75 of the plate to ensure the elastic, lateral displacement of the plate, without thereby activating the brake when the boot is in alignment with the longitudinal axis of the ski.

FIG. 18 represents a variation of the embodiment of the ski brake which functions basically in the same way as the embodiment of FIGS. 16 and 17.

The braking element is constituted by a single, elastically deformable metal rod, bent so that it will have:

a U-shaped, inverted middle part 80 which will remain over the surface of the ski and be actuated by the boot;

two rectilinear extensions 81 and 82 bent at an angle of approximately 90° and which engage in bearings 83 in the plane of the ski; said bearings are arranged in a part 84 attached to the ski and form between them an angle of less than 180°;

two end-branches 85–86, terminating extensions 81 and 82 respectively and forming therewith an angle of almost 90°. Branches 85–86 extend under the lower plane of the ski in reverse direction from the middle part.

Middle part 80 has attached to it, for example by casting it from the same plate, a control lever 87 in the form of an almost triangular plate with side ridges 88 and 89 converging in the direction of the mid, vertical plane of the ski, said plate extending across the longitudinal axis of the ski.

The top of plate 87 is advantageously truncated to allow for a flat, top part 90. Plate 87 of FIG. 18 cooperates with the boot in the same manner as the device shown in FIGS. 16 and 17.

It should be pointed out that whatever the type of fastening or brake utilised, there will be no departure from the framework of the invention. A ski brake with only one braking element is possible, embodied as in FIG. 18 so as to integrate the means for furnishing the effort using, for example, a steel-wire brake constructed for this purpose.

In addition, ramps 74 and 75 of FIGS. 16 and 17 could be placed directly on the sole of the boot, especially when in the presence of a boot-binding arrangement in which there is no plate attached temporarily under the boot.

Furthermore, the central, almost horizontal zone (76 in FIG. 17 and 90 in FIG. 18) can be situated either on the boot (as in FIG. 17) or on the control lever (as in FIG. 18), or even on both. With the ramps, the action of the boot on the control lever has a component situated in an almost vertical plane, and it is because of this component that the brake can tilt in order for it to pass from its active braking position to its inactive skiing position.

What is claimed is:

1. Braking device for a ski equipped with a boot-retention system in which the ski is put on by placing the boot at an oblique angle to the ski and substantially parallel to the upper plane thereof, then by causing the boot to pivot in the plane of the ski about a vertical axis perpendicular to the ski to align it with the longitudinal axis of said ski, in which position the boot is rigid with the ski because of a fastening system, said braking device comprising (a) at least one braking element movable with respect to the ski between an inactive position in which the braking element is raised above the bottom of the ski, and an active braking position in which the braking element protrudes from the underside of the ski; and (b) control means for actuating the braking element, at least one part of which reacts to the presence or absence of the boot on the ski;

(c) one part of said control means protruding when said braking element is in said active braking position, into a space which is to be occupied by an element associated with said boot when said boot is aligned with the longitudinal axis of the ski;

(d) said part of said control means being a movable part moved away from said space by a pushing action applied thereto by said boot associated element, said pushing action having at least a component force oriented in a plane parallel with the plane of the ski when said boot rotates in the plane of the ski;

(e) at least one of the elements including said part of said control means and said pivoted boot associated element having a cam profile cooperating with the other element and permitting displacement of said boot associated element relative to said part of said control means.

2. Braking device according to claim 1 wherein the movable part is elastically attracted into its protruding position by an elastic element assuring simultaneously the recall of the braking element to the active position.

3. Braking element according to claim 2, wherein the movable part is displaceable from its protruding position to a retracted position in which it is maintained by the element associated with the boot, by rotation of the movable part about at least one fixed point vis-a-vis the ski.

4. Braking element according to claim 3, wherein the movable part is constituted by the elbow-shaped extremity of a rod mounted for turning movement in a support which is integral with the ski, said rod extending over the plane of the ski and bearing the braking element which in rotation is integral with said rod.

5. Braking device according to claim 4, including a spring which extends between a fixed part of the ski and a part of the assembly constituted by the braking element and the rod, and which attracts this assembly into the active position of the braking element.

6. Braking device according to claim 4, taken, wherein the turning rod extends substantially parallel to the longitudinal axis of the ski and that the trajectory of the braking element is situated in a plane which is substantially transverse to the ski.

7. Braking element according to claim 4, wherein the movable part cooperates with the element which is integral with the boot and located in the immediate vicinity of the tip of the latter.

8. Braking device according to claim 3, wherein the movable part comprises a lever which rotates about a vertical axis integral with the ski and whose extremities are situated on both sides of the vertical axis, one extremity of the lever cooperating with the element which is integral with the boot, while the other is connected to the braking element which is mounted on a structure attached to the ski.

9. Braking element according to claim 8, wherein the connection between the lever and the braking element comprises wires which are guided to slide into an eyelet of the structure and are aligned with the longitudinal axis of the ski, said wires being fastened to the lever and to the corresponding braking element, respectively.

10. Braking device according to claim 8, wherein the hinge pin of the lever on the longitudinal axis of the ski and in front of the boot.

11. Braking device according to claim 3, wherein the movable part comprises a lever which turns around a vertical axis integral with the ski and whose extremities protrude from both sides of the vertical axis, one extremity of the lever cooperating with the element that is integral with the boot, while the other cooperates with an elastically displaceable part of the braking element.

12. Braking device according to claim 11, wherein the braking element comprises an elastically deformable rod, shaped so that it has two fragments substantially parallel to each other and lateral extensions of these fragments, the adjacent lateral extensions being connected to each other and extending nearly perpendicular to the fragments and normally protruding toward the lower plane of the ski, the two fragments extending substantially transversely to the longitudinal axis of the ski and parallel to the plane of the ski, one of said fragments being housed so that it rotates in a housing integral with the ski, while the other fragment is housed so that it slides and rotates in a groove extending parallel to the plane of the ski, lessening of the distance between the two fragments causing, by elastic deformation of the flexible rod, the latter to rise to an inactive position.

13. Braking device according to claim 12, wherein in that the elastically displacement part of the braking element is the fragment housed so that it slides in the groove, and the extremity of the lever cooperating with this sliding fragment is cam-shaped, so that when the lever rotates under the effect of the element integral with the boot, said fragment will move in translation.

14. Braking device according to claim, 12 for equipping a pivot-type binding in which one part of the releasable fastening means of the boot against the ski is borne by said pivot, while the other part of the fastening means is integral with the boot and comprises at least one piston attracted by a spring which cooperates with the housing provided on the pivot, the braking element being mounted in the pivot which contains the passage and the slot in which are housed the fragments of the rod forming the braking element, the movable part also being housed in the pivot so that it moves about a vertical axis provided therein.

15. Braking device according to claim 14, wherein the element integral with the boot which activates the lever comprises a stationary part of the fastening system connected to the boot, and the extremity of the lever which cooperates with this stationary part protrudes, when the ski is off, within the pivot-housing, said stationary the being in a position in which the boot is locked on the ski.

16. Braking device according to claim 1, wherein the movable part is displaceable by translation from its extended position to a retracted position in which it is maintained by the element associated with the boot.

17. Braking device according to claim 16 wherein the movable part is displaceable by translation in the plane of the ski between the grooves of a structure which is integral with the ski.

18. Braking device according to claim 16 or 17, wherein the movable part is displaceable by translation in a general direction parallel to the longitudinal axis of the ski.

19. Braking device according to claim 16, wherein the braking element comprises an elastically deformable rod shaped so that it has two fragments substantially parallel to each other, and lateral extensions of these fragments, the adjacent lateral extensions being connected to each other and extending in a plane which is almost perpendicular to the fragments, normally protruding from the underside of the ski, the two fragments extending substantially transversely to the longitudinal axis of the ski and parallel to the plane of the ski; one of said fragments being housed so that it turns in a housing which is integral with the ski, while the other is housed so that it also turns in a housing of a part moving in translation in the plane of the ski, lessening of the distance between the two fragments causing the extensions to rise to an inactive position.

20. Braking device according to claim 19, for equipping a pivot-type binding, in which one part of the releasable fastening means of the boot against the ski is borne by said pivot, while the other part of the fastening means is integral with the boot and comprising by at least one piston attracted by a spring which cooperates with a housing provided in the pivot, the pivot comprising a part attached to the ski and in which one of the fragments of the elastically deformable rod engages, and a part which moves in translation on the stationary part, by means of grooves, said movable part having a housing in which the second fragment of the elastic rod engages, the movable part of the pivot being kept apart from the stationary part by the elastic effort of the elastic rod against the action of which the two parts of the pivot are brought together when the piston of the fastening means becomes locked in its housing on the pivot.

21. Braking device according to claim 2, wherein the movable part cooperates with the element connected to the boot by means of a ramp system.

22. Braking device according to claim 21, wherein the movable part and/or the bootconnected element has at least one ramp.

23. Braking device according to claim 22, wherein the ramp of the movable element is in a plane substantially transverse to the ski.

24. Braking device according to claim 1, wherein the braking element comprises an elastically deformable rod shaped so that it has two fragments which are substantially parallel to each other and lateral extensions of these fragments, the adjacent lateral extensions being connected to each other and extending in a plane substantially perpendicular to the fragments, normally protruding from the underside of the ski, the two fragments extending almost transversely to the longitudinal axis of the ski and parallel to its plane, one of said fragments being housed so that it turns in a housing integral with the ski, while the other fragment is housed so that it slides and turns in a groove, also integral with the ski, the bringing together of the two fragments causing, by elastic deformation of the elastic rod, the rising of the latter to an inactive position.

25. Braking device according to claim 24, wherein the movable part comprises the fragment which slides in the groove, and the element integral with the boot is a nib perpendicular to the sole of the boot and which, when the boot is positioned, engages against the sliding fragment, inside an inlet of the pivot, said nib moving in translation in the inlet, pushing back the sliding fragment when the boot is rotated, locking it into the fastening position on the ski.

26. Device according to claim 24 or 25, wherein the groove extends in the direction of the longitudinal exis of the ski and parallel to its plane.

27. Device according to claim 24 or 25, wherein the groove has an upper sliding surface at an oblique angle to the plane of the ski and rising in the direction of the housing integral with the ski in which the other fragment rotates.

28. Device according to claim 25, wherein the nib attached to the boot is mounted so that it is elastically movable with respect to the boot.

29. Device according to claim 28, wherein the nib comprises a rod on which a sleeve is mounted and retained elastically by a spring on the rod.

30. Device according to claim 1, wherein, characterized the movable part comprises two positioning ramps that are symmetrical to the longitudinal axis of the ski and form an inverted "V" whose plane is transverse to the longitudinal axis of the ski.

31. Device according to claim 30, wherein the ramps are arranged on the edges of a plate attached to the movable part.

32. Device according to claim 31, wherein the movable part is an integral part of an elastically deformable rod, constituting the middle element thereof, in the form of a stirrup, said stirrup being extended on each side by elbow-shaped extensions turning in bearings integral with the ski and themselves terminated by extremities which are bent back and extend in the opposite direction from the stirrup constitute the braking element per se.

33. Device according to any one of claims 30, 31 or 32, wherein the positioning ramps cooperate with inclined planes, converging toward the ski and arranged in front of the boot or in front of a part inserted under the sole of the boot.

* * * * *

UNITED STATES PATENT AND TRADEMARK OFFICE

CERTIFICATE OF CORRECTION

PATENT NO. : 4,168,849

DATED : SEPTEMBER 25, 1979

INVENTOR(S) : GEORGES, PIERRE, JOSEPH SALOMON

It is certified that error appears in the above-identified patent and that said Letters Patent are hereby corrected as shown below:

Claim 6, line 1, cancel "taken";

line 3, cancel "that"

Claim 10, line 2, after "lever" insert --is situated--

Claim 13, lines 1 and 2, cancel "in that"

Claim 15, line 7, cancel "the" (first occurrence)

Claim 20, line 5, change "comprising by" to --comprises--

Claim 26, line 2, correct spelling of --axis--

Claim 32, line 8, after "stirrup" insert --and--

Signed and Sealed this

*Twenty-fifth* Day of *December 1979*

[SEAL]

*Attest:*

SIDNEY A. DIAMOND

*Attesting Officer*

*Commissioner of Patents and Trademarks*